US007049477B2

(12) United States Patent
Chae et al.

(10) Patent No.: US 7,049,477 B2
(45) Date of Patent: May 23, 2006

(54) PROCESS FOR PYROLYSIS OF HYDROCARBON

(75) Inventors: Jong-Hyun Chae, Daejeon (KR); Won-Ho Lee, Daejeon (KR); Sang-Mun Jeong, Daejeon (KR); Jun-Han Kang, Daejeon (KR)

(73) Assignee: LG Chem, Ltd. (KR)

( * ) Notice: Subject to any disclaimer, the term of this patent is extended or adjusted under 35 U.S.C. 154(b) by 295 days.

(21) Appl. No.: 10/482,181

(22) PCT Filed: Nov. 5, 2002

(86) PCT No.: PCT/KR02/02054

§ 371 (c)(1),
(2), (4) Date: Dec. 23, 2003

(87) PCT Pub. No.: WO03/091360

PCT Pub. Date: Nov. 6, 2003

(65) Prior Publication Data

US 2004/0186335 A1 Sep. 23, 2004

(30) Foreign Application Priority Data

Apr. 23, 2002 (KR) ..... 10-2002-0022326

(51) Int. Cl.
*C07C 4/02* (2006.01)

(52) U.S. Cl. ..... 585/653; 585/648; 585/650; 585/651; 585/652; 585/921; 585/950

(58) Field of Classification Search ..... 508/648, 508/650–653, 921, 950; 208/118, 121, 124, 208/130
See application file for complete search history.

(56) References Cited

U.S. PATENT DOCUMENTS

| | | | | |
|---|---|---|---|---|
| 3,872,179 | A | 3/1975 | Andersen et al. | 260/683 R |
| 4,342,642 | A | 8/1982 | Bauer et al. | 208/130 |

FOREIGN PATENT DOCUMENTS

| | | |
|---|---|---|
| DE | 42 13 696 A1 | 10/1993 |
| EP | 1 122 294 A2 | 8/2001 |
| FR | 2 688 797 | 9/1993 |
| JP | 9-292191 | 11/1997 |
| JP | 11-199876 | 7/1999 |
| SU | 1011236 A | 9/1981 |

OTHER PUBLICATIONS

PCT International Search Report; International application No. PCT/KR02/02054; International filing date: Nov. 5, 2002; Date of Mailing: Feb. 17, 2003.

*Primary Examiner*—Walter D. Griffin
*Assistant Examiner*—In Suk Bullock
(74) *Attorney, Agent, or Firm*—Cantor Colburn LLP

(57) ABSTRACT

The present invention relates to a process for pyrolysis of hydrocarbons for olefin preparation, and particularly to a process for pyrolysis of hydrocarbons comprising pyrolyzing paraffin hydrocarbons in the presence of steam to prepare olefins, where the pyrolysis is conducted in a pyrolysis reaction tube in which a porous inorganic substance with a pore diameter of 1 μm~5 mm, a porosity of 10~80%, and a maximum specific surface area of 0.1 $m^2/g$ is inserted or filled. According to the present invention, in the hydrocarbon pyrolysis process, the porous inorganic substance is inserted or filled into the pyrolysis reaction tube, and thus the olefin yield can be improved compared to the conventional pyrolysis processes, a continuous operation period can be prolonged, and a life cycle of the pyrolysis reaction tube can be prolonged.

9 Claims, 4 Drawing Sheets

PROCESS FOR PYROLYSIS OF HYDROCARBON

BACKGROUND OF THE INVENTION (a) Field of the Invention

The present invention relates to a process for pyrolysis of hydrocarbons for olefin preparation, and more particularly to a hydrocarbon pyrolysis process that inserts or fills a porous inorganic substance into a pyrolysis tube, and thus has a higher olefin yield compared to a conventional pyrolysis process, and which can reduce the amount of coke accumulated on the wall surface of a pyrolysis reaction tube thereby prolonging a coke removal cycle, and which can lower a surface temperature of a pyrolysis reaction tube compared to conventional pyrolysis thereby prolonging the life cycle of the reaction tube.

(b) Description of the Related Art

Olefin compounds such as ethylene and propylene are important basic raw materials for petrochemicals. These olefin compounds are prepared by pyrolyzing paraffin-rich hydrocarbons such as natural gas, naphtha, light oil, etc. as a main component.

Pyrolysis of hydrocarbons, which is an endothermic reaction, commonly proceeds in a high temperature tube that is heated by a burner in the presence of steam. During pyrolysis of hydrocarbons, in order to increase olefin yield, the reaction temperature is increased and the residence time of the reactant is controlled to be short. Steam that is used as a diluting agent for hydrocarbons removes coke and lowers the partial pressure of the hydrocarbons to improve olefin selectivity.

In common industrial processes, the reaction temperature that is based on the outlet temperature of a reactor is approximately 830° C., the residence time of the reactant is 0.1~0.2 seconds, and the flow rate of steam is 0.4~0.7 times that of the hydrocarbons on the basis of weight ratio. In the hydrocarbon pyrolysis process, a coke is excessively produced, which is accumulated on the wall surface of a pyrolysis tube and increases heat transfer resistance. In order to maintain a constant olefin yield during operation of the reactor, the outlet temperature of the reactor should be constantly maintained, and if heat transfer resistance of a pyrolysis tube increases due to coke accumulation, the surface temperature of the pyrolysis tube should be gradually elevated in order to compensate for this.

In the case of common industrial pyrolysis, the surface temperature of the pyrolysis tube is approximately 1000° C. at initial operation, and if the surface temperature of the tube reaches approximately 1100° C. as coke is accumulated on the wall surface thereof, the operation must be interrupted to remove the coke. The number of continuous operation days of a hydrocarbon pyrolysis process varies according to the process and operation conditions, and continuous operation is generally conducted for 30~40 days.

In a hydrocarbon pyrolysis process, in order to increase overall olefin productivity, either the olefin yield must increase or the continuous operation time of the pyrolysis process must be prolonged, and for this, various methods have been suggested.

U.S. Pat. No. 4,342,642 has suggested a method for improving heat transfer by introducing into the reaction tube an insert consisting of a shaft and wings that contacts or approaches the inner wall of a pyrolysis reaction tube. French Patent No. 2,688,797 has reported a method for introducing an insert having a long surface along with a shaft in the back end of a pyrolysis reaction tube to increase heat transfer and generate a warm current, thereby uniformly heating the reaction mixture in the tube. Additionally, Japanese Laid-Open Patent Publication No. Hei 9-292191 has suggested a method for arranging bars to which pins are fixed along with a shaft of a pyrolysis reaction tube so that fluid passing through the reaction tube can be mixed.

The above-mentioned processes commonly suggest technologies for improving ethylene yield by arranging inserts inside a pyrolysis tube to increase heat transfer efficiency, but they cannot remove coke produced on the surface of the inserts, and they also cannot make use of the inside volume or surface of the inserts for pyrolysis.

Japanese Laid-Open Patent Publication No. Hei 11-199876 has suggested a novel pyrolysis tube, on the inner wall of which a spiral projection is formed. The spiral projection in the pyrolysis reaction tube removes a flow of fluid that stagnates around the inner wall of the tube to prevent excessive heating of fluid at that position, thereby decreasing coke production. However, although this method has the effect of prolonging the cycle of removing coke accumulated on the pyrolysis tube, it has little effect for improving ethylene yield.

Meanwhile, as a method for improving ethylene and propylene yield in hydrocarbon pyrolysis, a process using a catalyst has been suggested. U.S. Pat. No. 3,872,179 has suggested a catalyst in which an alkali metal oxide is added to a zirconium catalyst, and Russian Patent No. 1,011,236 has suggested a potassium vanadate catalyst in which boron oxide is supported on an alumina carrier. However, although these catalysts can remove coke, these processes have disadvantages in that a concentration of COx produced when removing the coke is high according to properties of the catalysts, and pressure drop across catalyst bed is high. If the COx concentration is high or pressure build-up across the reactor is significant, the operation cost of the process significantly increases and various problems are caused to the operation of the process.

SUMMARY OF THE INVENTION

The present invention is made in consideration of the problems of the prior art, and it is an object of the present invention to provide a novel process for pyrolysis of hydrocarbons that can increase yield of olefins such as ethylene, propylene, butadiene, etc. compared to the existing pyrolysis processes, and that can increase the number of continuous operation days.

It is another object of the present invention to provide a process for pyrolysis of hydrocarbons that can prolong the life cycle of a pyrolysis tube.

In order to achieve these objects, the present invention provides a process for pyrolysis of hydrocarbons comprising pyrolyzing paraffin-rich hydrocarbons in the presence of steam to prepare olefins, wherein the pyrolysis is conducted in a pyrolysis reaction tube in which a porous inorganic substance with a pore diameter of 1 μm~5 mm, a porosity of 10~80%, and a maximum specific surface area of 0.1 $m^2/g$ is inserted or filled.

DETAILED DESCRIPTION AND THE PREFERRED EMBODIMENTS

Figure 1A:
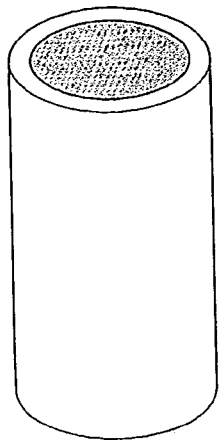
FIG. 1*a* shows a tubular insert according to the present invention.

The present invention will now be explained in detail.

The present invention provides a novel hydrocarbon pyrolysis process in which a porous inorganic substance is inserted or filled in line into a tubular pyrolysis reaction tube commonly used for hydrocarbon pyrolysis.

The pyrolysis of hydrocarbons prepares olefin compounds such as ethylene, propylene, and butadiene by pyrolyzing a raw material such as natural gas, naphtha, light oil, etc. having paraffin-rich hydrocarbons as a main component, in the presence of steam.

The present invention can improve yield of olefins such as ethylene, propylene, butadiene, etc. by inserting or filling a porous inorganic substance into the pyrolysis reaction tube. Specifically, according to the present invention, the porous inorganic substance inserted or filled acts as a heat transfer medium to facilitate heating of hydrocarbons and to uniformly mix hydrocarbons, thereby improving pyrolysis and the conversion rate of hydrocarbons. Additionally, the porous inorganic substance includes macropores, which act as a pyrolysis reaction tube with a small diameter to efficiently facilitate pyrolysis of hydrocarbons and thereby improve olefin yield.

In addition, according to the present invention, since operation is possible while maintaining the metal temperature of the pyrolysis tube at a temperature lower than that of an existing pyrolysis tube, the formation rate of surface coke that forms on the inside surface of the pyrolysis tube can be reduced. Also, the substance that is inserted into the pyrolysis tube collects gas-phase pyrolytic coke which normally accumulates on the inner wall surface of the pyrolysis tube, to reduce coking of the wall surface thereof, and thus it performs a function of maintaining good heat transfer efficiency of the pyrolysis tube. Therefore, according to the present invention, elevation of tube metal temperature, which results from coke accumulation on the inner wall surface, can be greatly reduced and thus a continuous operation period can be prolonged.

During the pyrolysis of hydrocarbons, coke accumulated on the insert is removed as CO or $CO_2$ by the action of compounds coated on the surface of the insert, and the coke that is not thus removed is removed when decoking. The present invention also has an advantage in that coke removal from the insert is easier compared to removing surface coke formed on the wall surface of the pyrolysis tube.

As the porous inorganic substance inserted or filled in the pyrolysis tube of the present invention, a refractory oxide made of airtight or porous material that can withstand a high temperature is preferably used. The refractory oxide is preferably selected from the group consisting of alumina, silica, magnesium oxide, calcium oxide, ferrous oxide, zirconium oxide, and a mixture thereof.

The porous inorganic substance preferably has a pore diameter of 1 μm~5 mm, a porosity of 10~80%, and a maximum specific surface area of 0.1 $m^2/g$. If the pore diameter is less than 1 μm, pore blocking due to coking rapidly proceeds and thus cracking of hydrocarbons is limited in the pores, and if it exceeds 5 mm, the strength of the porous inorganic substance diminishes. If the porosity is less than 10%, the ethylene yield improvement effect is reduced due to a decrease in reaction volume in the inorganic substance where pyrolysis of hydrocarbons occurs, and if it exceeds 80%, the strength of the porous inorganic substance diminishes. Also, if the specific surface area exceeds the above range, the coke production amount increases, which causes the generation of CO and $CO_2$ to increase.

In addition, the present invention can reduce coke accumulation and make coke removal easier if the surface of the porous inorganic substance is coated with an alkali metal or an alkaline earth metal compound. The alkali metal compound includes sodium and potassium compounds, and is preferably selected from the group consisting $KVO_3$, $K_2CO_3$, $KBO_2$, $KWO_3$, $KNbO_3$, $K_2SO_4$, and a mixture thereof.

The form of the insert the filling in the pyrolysis reaction tube is preferably a filling body, a dividing body dividing the inside of the tube in a lengthwise direction, or a mixed form thereof.

Figure 1B:
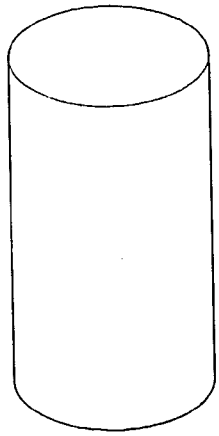
FIG. 1*b* shows a cylindrical insert.
Figure 1C:
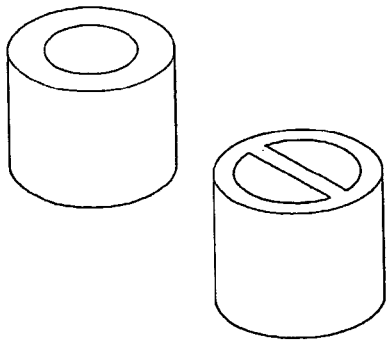
FIG. 1*c* shows a ring-shaped insert.

The filling body is preferably of a tubular shape, the inside of which is hollow (FIG. 1*a*); a cylindrical shape (FIG. 1*b*); or a ring shape such as a Raschig ring, a Lessing ring, a Pall ring, etc. (FIG. 1*c*).

Figure 1D:
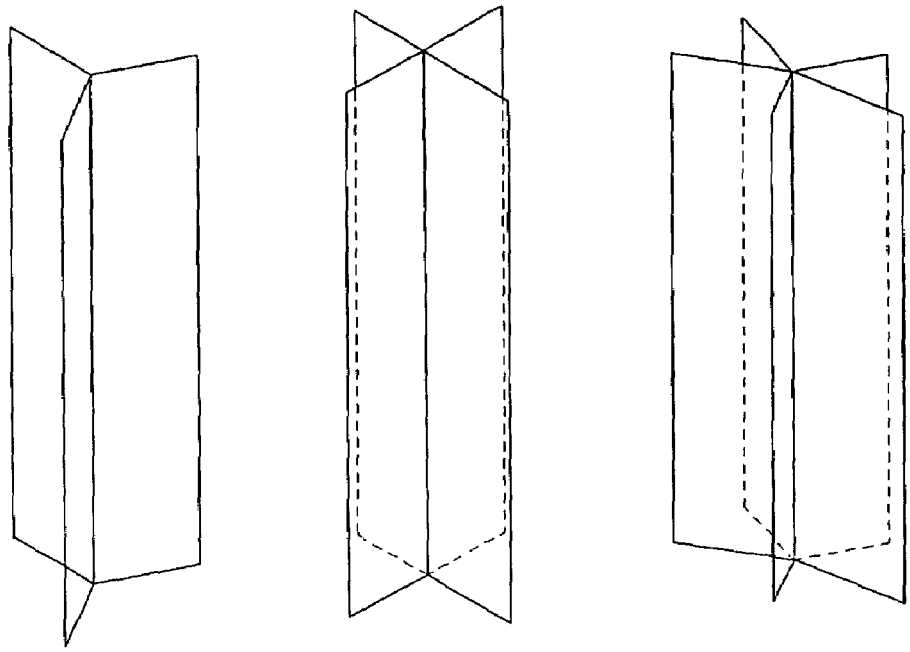
FIG. 1*d* shows the form of an insert equally dividing a pyrolysis reaction tube into three, four, or five sections.
Figure 1E:
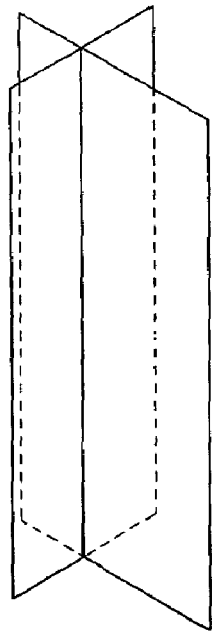
FIG. 1*e* shows the form of an insert unequally dividing a pyrolysis reaction tube.

The dividing body includes forms for equally dividing the cross section of the pyrolysis tube into three, four, or five sections (FIG. 1*d*); and forms for unequally dividing the cross section (FIG. 1*e*).

Figure 1F:
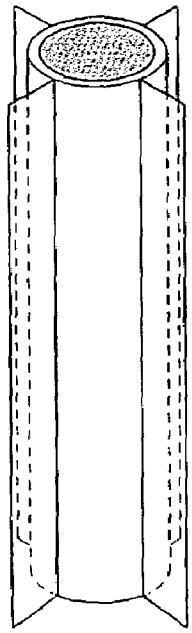
FIG. 1*f* shows a mixture of forms thereof.

In the present invention, a mixed form combining the above forms is preferable (FIG. 1*f*).

The equal division form preferably consists of a plurality of blades, which has the same distances from the one side edge where they are contacted with each other to the other side edge, so that a reaction mixture of hydrocarbons and steam can be equally divided. The unequal division form preferably consists of a plurality of blades, of which distances from the one side edge where they are contacted with each other to the other side edge are the same or some of them are different, so that a reaction mixture of hydrocarbons and steam can be unequally divided.

The number of inserts filled into the pyrolysis tube is one or more according to their length, and according to the circumstances there can be a few tens to a few hundred of them, in line. In order to improve ethylene yield, each insert is preferably divided form in a lengthwise direction rather than a single form.

If a few tens or a few hundred solid inserts are filled into a pyrolysis tube, a surface direction provided by the inserts is preferably controlled so as to be parallel with the radial direction of the pyrolysis tube. The surface direction of the insert is defined as a direction perpendicular to the tangent plane. And, in the case of a tubular-shaped insert, it is preferable to punch a plurality of holes in the tubular insert so that fluid inside and outside of the tubular insert can be mixed. In addition, in the case of dividing bodies that equally divide a cross section of the pyrolysis tube into three, four, or five sections, or unequally divide it, it is preferable to insert them so that the dividing cross sections may be offset from each other, which repeatedly mixes and separates the reaction mixture flow in the reaction tube, thereby making it more uniform.

Figure 2:
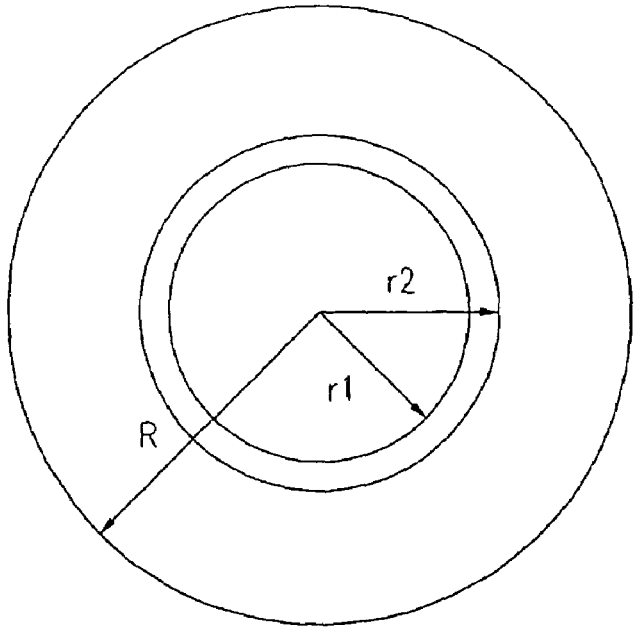
FIG. 2 shows the inside radius (r1) and the outside radius (r2) of a tube, in the case of inserting a porous inorganic substance of tubular shape into a pyrolysis reaction tube.

In addition, in the case a tubular insert is inserted into a pyrolysis tube with a radius of "R", the insert has inside and outside radii as calculated in the following Mathematical Formulae 1 and 2 (FIG. 2).

$$r1=0\sim0.9r2 \quad \text{[Mathematical Formula 1]}$$

$$r2=0.2R\sim0.8R \quad \text{[Mathematical Formula 2]}$$

In the Mathematical Formulae 1 and 2, r1 is the inside radius of the tubular insert, r2 is the outside radius of the tubular insert, and R is a radius of the pyrolysis tube.

If r1=0, it corresponds to a cylindrical insert, and in the case a ring-shaped insert such as a Raschig ring, a Lessing ring, a Pall ring, etc. is inserted, the inside and outside radii also follow the above Mathematical Formulae 1 and 2.

The insert is inserted or filled into all or part of the pyrolysis tube along the lengthwise direction thereof. In the case the pyrolysis tube is of a U-shape that is divided into an inlet tube and an outlet tube, filling may be conducted into the inlet tube only, into the outlet tube only, into both the inlet tube and the outlet tube, or into a part of the inlet tube or the outlet tube. And, in the case the diameters of the inlet tube and the outlet tube are different, an insert with a size following the above Mathematical Formulae 1 and 2 is filled. At this time, a decrease in volume of the inside of the pyrolysis tube after inserting the insert is preferably limited within the range of 5~30 vol %, and a decrease in cross section of the pyrolysis tube due to the insert is also preferably limited within the range of 5~30 vol %.

When filling the insert into the pyrolysis tube, according to circumstances, a supporter capable of supporting the insert should be installed inside the pyrolysis tube, while the opening ratio of the supporter is preferably maintained to be 0.5 or more. The supporter is fixed by directly welding it to the pyrolysis tube, or it is installed by welding a projection inside the pyrolysis tube and mounting the supporter on the projection. And, in case the pyrolysis tube is of a U-shape connected by a manifold and the insert is filled in one or more of the inlet tube and the outlet tube, the insert can be filled without a supporter, which can remove a pressure drop generated by installation of the supporter.

The hydrocarbon pyrolysis process of the present invention is conducted under common steam pyrolysis process conditions. For example, steam pyrolysis can be conducted under conditions of a reaction temperature of 600~1000° C., a ratio of steam/hydrocarbons of 0.3~1.0, and a LHSV (Liquid Hourly Space Velocity) of hydrocarbons of 1~20 $hr^{-1}$, to prepare olefins.

As explained, according to the present invention, ethylene, propylene, and butadiene can be obtained with a high yield compared to the existing pyrolysis processes, and the metal temperature of a pyrolysis tube can be reduced by a few tens of degrees, and particularly coke accumulated on the inner wall of the pyrolysis tube can be reduced thereby prolonging the coke removal cycle.

The present invention will be explained in more detail with reference to the following Examples. However, these are to illustrate the present invention, and the present invention is not limited to them.

EXAMPLES

Examples 1-1 to 1-6 and Comparative Example 1

Naphtha was used as the hydrocarbon source in Examples of the present invention, and the composition and properties thereof are as shown in Table 1.

TABLE 1

| | |
|---|---|
| Specific gravity (g/cc) | 0.675 |
| Initial boiling point (° C.) | 30.9 |
| End boiling point (° C.) | 160.7 |
| n-paraffin (wt %) | 39.5 |
| i-paraffin (wt %) | 38.9 |
| naphthene (wt %) | 15.3 |
| aromatics (wt %) | 6.3 |

Reactants comprising naphtha and water were injected into a reaction apparatus using a metering pump, with the injection ratio of naphtha and water controlled to 2:1 and the flow rate of naphtha controlled so that its LHSV (Liquid Hourly Space Velocity) became 10. The naphtha and water injected in the reaction apparatus were respectively passed through a vaporizer and mixed, and then passed through a first preheater heated to 550° C. and then a second preheater heated to 650° C., and injected into a pyrolysis reaction tube. At this time, the pyrolysis reaction tube was heated to 880° C. by an electric furnace consisting of three sections, and the steam/naphtha mixture passing through the second preheater was pyrolyzed while passing through the pyrolysis reaction tube. The reaction product passing through the pyrolysis reaction tube was condensed to water and heavy oil while passing through two condensers connected in series and separated into a liquid phase, and the remaining gas-phase mixture was analyzed with a gas chromatograph (GC) connected on line and discharged.

The ethylene yield was calculated by the following Mathematical Formula 3, and yields of other products were also calculated by the same method.

$$\text{Ethylene yield (wt\%)} = \frac{\text{Output of ethylene}}{\text{Input of naphtha}} \times 100 \quad \text{[Mathematical Formula 3]}$$

In the following Table 2, results of pure pyrolysis of naphtha, in which solid material was not filled in a pyrolysis reaction tube (Comparative Example 1), and those of pyrolysis in which oxides A and B were filled into a pyrolysis reaction tube (Examples 1-1 and 1-2) are shown in comparison. The oxide A is an non-porous alumina ball with a diameter of 5 mm, and the oxide B is a porous alumina ball with a diameter of 5 mm, and they were filled in a pyrolysis reaction tube in line in a zigzag form. The filled height of the oxides A and B were respectively 60 cm.

TABLE 2

| | Comparative Example 1 | Example 1-1 | Example 1-2 |
|---|---|---|---|
| Naphtha pyrolysis process | No filling | Filled with oxide A | Filled with oxide B |
| Size of pyrolysis reaction tube | Outside diameter ⅜ inches length 60 cm quartz tube | Outside diameter ⅜ inches length 60 cm quartz tube | outside diameter ⅜ inches length 60 cm quartz tube |
| Reaction condition | | | |
| Naphtha(g/min) | 3.0 | 3.0 | 3.0 |
| Water(g/min) | 1.5 | 1.5 | 1.5 |
| water/naphtha weight ratio | 0.5 | 0.5 | 0.5 |
| LHSV, $hr^{-1}$ | 10 | 10 | 10 |

TABLE 2-continued

| | Comparative Example 1 | Example 1-1 | Example 1-2 |
|---|---|---|---|
| (based on naphtha) | | | |
| Reaction temperature(° C.) | 880 | 880 | 880 |
| Product yields (wt %) | | | |
| $H_2$ | 0.57 | 0.88 | 0.87 |
| CO | 0.05 | 0.06 | 0.08 |
| $CO_2$ | 0.0 | 0.0 | 0.0 |
| $CH_4$ | 10.18 | 12.00 | 12.99 |
| $C_2H_4$ | 27.17 | 31.94 | 33.45 |
| $C_3H_6$ | 14.87 | 15.20 | 15.24 |
| $C_2H_4 + C_3H_6$ | 42.04 | 47.14 | 48.69 |

Naphtha pyrolysis was respectively conducted using a quartz tube as an insert in a pyrolysis reaction tube (Example 1-3) and using quartz rings made by cutting a quartz tube (Example 1-4), and the results are shown in the following Table 3. The quartz tube inserted into the pyrolysis tube had an outside diameter of 6 mm and a length of 17 cm, while the outside diameter of the quartz rings was 6 mm and the height was 1 cm, and they were filled in the reaction tube in line to a filled height of 17 cm.

TABLE 3

| | Comparative Example 1 | Example 1-3 | Example 1-4 |
|---|---|---|---|
| Naphtha pyrolysis process | No filling | Quartz tube insert | Quartz ring insert |
| Size of pyrolysis reaction tube | Outside diameter ½ inches length 17 cm quartz tube | Outside diameter ½ inches length 17 cm quartz tube | Outside diameter ½ inches length 17 cm quartz ring |
| Reaction condition | | | |
| Naphtha(g/min) | 1.6 | 1.6 | 1.6 |
| Water(g/min) | 0.8 | 0.8 | 0.8 |
| water/naphtha weight ratio | 0.5 | 0.5 | 0.5 |
| LHSV, hr−1 (based on naphtha) | 10 | 10 | 10 |
| Reaction temperature(° C.) | 920 | 920 | 920 |
| Product yield (wt %) | | | |
| $H_2$ | 0.12 | 0.17 | 0.13 |
| CO | 0.06 | 0.07 | 0.06 |
| $CO_2$ | 0.0 | 0.0 | 0.0 |
| $CH_4$ | 10.10 | 10.70 | 12.26 |
| $C_2H_4$ | 25.48 | 27.51 | 30.88 |
| $C_3H_6$ | 12.92 | 15.82 | 15.85 |
| $C_2H_4 + C_3H_6$ | 38.40 | 43.33 | 46.73 |

Naphtha pyrolysis was respectively conducted using α-alumina as a filling in a pyrolysis reaction tube (Example 1-5) and using α-alumina coated with $KVO_5$ (Example 1-6) for 4 hours, and the amount of coke accumulated on the filling for each case is shown in Table 4. The α-alumina and the α-alumina coated with $KVO_5$ used as filling in the pyrolysis tube were the same kind of spherical porous α-alumina, with a diameter of 5 mm. The height of the filling in each pyrolysis tube in line in a zigzag form was 17 cm.

TABLE 4

| | Example 1-5 | Example 1-6 |
|---|---|---|
| Filling used for naphtha pyrolysis | α-alumina | $KVO_3$-coated α-alumina |
| Size of pyrolysis reaction tube | Outside diameter ½ inches length 17 cm | Outside diameter ½ inches length 17 cm |
| Reaction condition | | |
| Naphtha(g/min) | 1.6 | 1.6 |
| Water(g/min) | 0.8 | 0.8 |
| water/naphtha weight ratio | 0.5 | 0.5 |
| LHSV, $hr^{-1}$ (based on naphtha) | 10 | 10 |
| Reaction temperature(° C.) | 920 | 920 |
| Coke production/ naphtha injection (wt %) | 0.51 | 0.18 |

Examples 2-1 to 2-3 and Comparative Examples 2-1 to 2-2

In a reactor with pilot scale, pyrolysis of naphtha was conducted. Reactant naphtha was vaporized and provided to a reaction apparatus, and steam supplied for utility was injected into the reaction apparatus. The flow rate of naphtha was controlled to 50 kg/hr by a metering pump, and the temperature was elevated to 300° C. while passing through a vaporizer heated to 730° C. The vaporized naphtha was mixed with steam at 210° C. (flow rate of steam 25 kg/hr) and transferred to a preheater, and the temperature of the naphtha/steam mixture was elevated to 650° C. while passing through a preheater of 950° C. and the mixture was injected into a pyrolysis reaction tube. The pyrolysis reaction tube had an inside diameter of 57 mm and a length of 3 m, and it was heated by an electric furnace consisting of 5 sections, the temperature of which was maintained constant.

The temperature of the electric furnace was controlled to 1000~1100° C., and pyrolysis occurred while the naphtha/steam mixture passed through the pyrolysis reaction tube heated by the electric furnace. The product passing through the pyrolysis reaction tube was cooled to steam, separated into gas-phase and liquid-phase mixtures, and exhausted. Some of the reaction product coming from the pyrolysis tube was injected into a sample collection line, passed through a condenser, and separated into gas and liquid mixtures. The gas mixture was analyzed with an on-line GC, and the oil component of the liquid mixture was separated with a separator funnel and analyzed with an off-line GC.

Pyrolysis was conducted under the same conditions (naphtha and steam flow rates, outlet temperature of a reactor) as in the above process, and the results of the existing pure pyrolysis (Comparative Example 2-1) and the pyrolysis of the present invention (Example 2-1) are shown in Table 5 for comparison. The pure pyrolysis of Comparative Example 2-1 is conducting naphtha pyrolysis without filling an insert into a reaction tube, and in Example 2-1, porous alumina Raschig rings (outside diameter 32 mm, height 32 mm, thickness 5 mm) coated with $KVO_5$, $B_2O_5$, $Fe_2O_3$ are filled into a pyrolysis tube in line with a height of 3 m and pyrolysis is conducted.

TABLE 5

| | Comparative Example 2-1 | Example 2-1 |
|---|---|---|
| Reaction conditions | | |
| Naphtha flow rate (kg/hr) | 50 | 50 |
| Steam flow rate (kg/hr) | 25 | 25 |
| Outlet pressure of reactor (atm) | 1.08 | 1.08 |
| ΔP of reactor (atm) | 0.02 | 0.16 |
| Outlet temperature of reactor (° C.) | 850 | 850 |
| Metal temperature of pyrolysis tube (° C.) | 1089 | 1052 |
| Products(wt %) | | |
| H2 | 0.85 | 0.99 |
| CO | 0.05 | 0.005 |
| CO2 | 0.05 | 0.08 |
| Methane | 12.6 | 16.53 |
| Ethane | 3.39 | 4.01 |
| Ethylene | 26 | 31.78 |
| Acetylene | 0.35 | 0.49 |
| Propane | 0.49 | 0.5 |
| Propylene | 15.1 | 16.02 |
| C3 Others | 0.22 | 0.31 |
| 1,3-butadiene | 4.02 | 4.71 |
| C4 others | 7.96 | 5.79 |
| n-pentane | 3.65 | 0.76 |
| i-pentane | 2.95 | 0.54 |
| C5 others | 7.3 | 2.91 |
| C6~C8 ARO | 3.84 | 1.85 |
| Benzene | 4.85 | 4.2 |
| Toluene | 2.33 | 3.05 |
| Ethylbenzene + xylenes | 0.82 | 1.03 |
| Styrene | 0.77 | 1.06 |
| C9 + S | 2.5 | 3.41 |
| Total | 100 | 100 |

As shown in Table 5, when conducting naphtha pyrolysis according to pure pyrolysis (Comparative 2-1) and according to the pyrolysis of the present invention (Example 2-1), metal temperatures of each pyrolysis tube were different even at the same reactor outlet temperature .

In the following Table 6, metal temperatures of pyrolysis tubes when pyrolyzing naphtha according to pure pyrolysis (Comparative Example 2-2) and according to the pyrolysis of the present invention (Example 2-2), in the case the COT (Coil Outlet Temperature) is controlled to 820~850° C., are shown for comparison.

TABLE 6

| COT(° C.) | Comparative Example 2-2 metal temperature of pyrolysis tube at pure pyrolysis(° C.) | Example 2-2 metal temperature of pyrolysis tube when filling 32 mm ring(° C.) |
|---|---|---|
| 820 | 1031 | 1020 |
| 830 | 1050 | 1032 |
| 840 | 1069 | 1041 |
| 850 | 1089 | 1052 |

Figure 3:
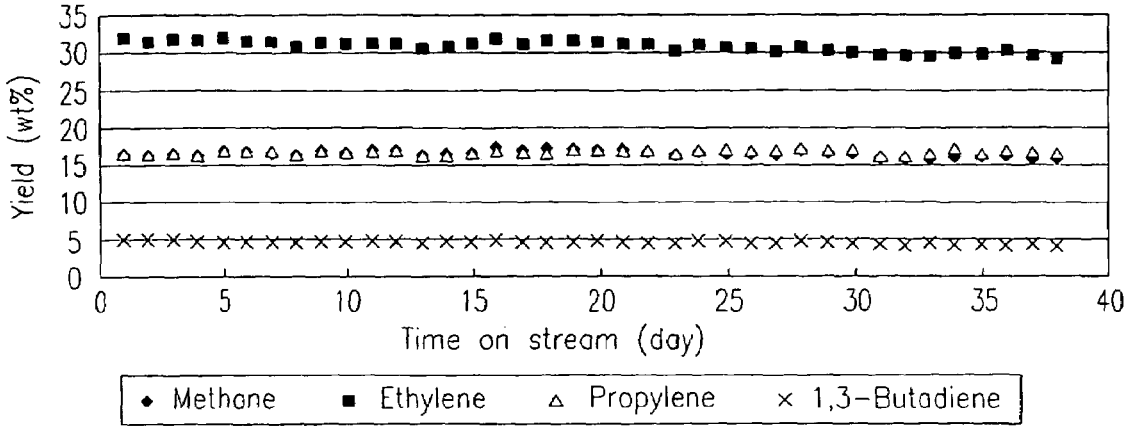
FIG. 3 shows changes in yields of methane, ethylene, propylene, and butadiene while conducting naphtha cracking for 40 days in a pyrolysis reaction tube according to the present invention.
Figure 4:
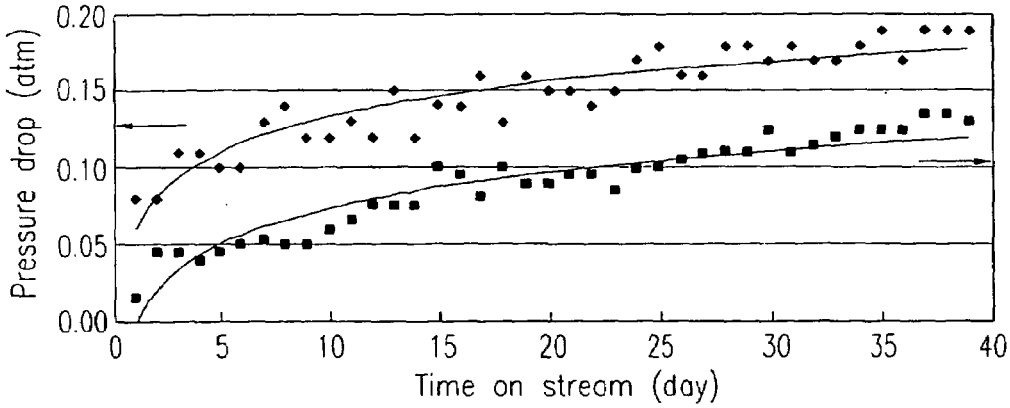
FIG. 4 shows changes in metal temperature of a pyrolysis tube and pressure drop (Δp) of a pyrolysis tube filled with an alumina ring while conducting naphtha cracking for 40 days in a pyrolysis reaction tube according to the present invention.

32 mm alumina rings coated with $KVO_5$-$B_2O_5$- $Fe_2O_3$ were filled into a pyrolysis tube in line to a height of 3 m, and then naphtha pyrolysis was conducted continuously for 40 days (Example 2-3). The results are shown in FIGS. 3 and 4. The hydrocarbon pyrolysis process was the same as explained above, and the temperature of the electric furnace was controlled so that the COT (coil outlet temperature) was maintained at 850° C. during the continuous operation. FIG. 3 shows changes in methane, ethylene, propylene, and butadiene yields while conducting naphtha pyrolysis for 40 days, and FIG. 4 shows changes in the metal temperature of the pyrolysis tube and pressure drop (Δp) of the pyrolysis tube filled with the above mentioned alumina rings while conducting naphtha pyrolysis for 40 days.

As seen from the results of FIGS. 3 and 4, in Examples 2 and 3 the porous inorganic substance was filled into a pyrolysis reaction tube thereby improving olefin yield.

As explained, according to the present invention, olefin yield can be improved compared to conventional pyrolysis, a continuous operation period can be prolonged, and life cycle of a pyrolysis tube can be prolonged, by inserting or filling a porous inorganic substance into a hydrocarbon pyrolysis reaction tube in a hydrocarbon pyrolysis process.

What is claimed is:

1. A process for pyrolysis of hydrocarbons comprising pyrolyzing paraffin-rich hydrocarbons in the presence of steam to prepare olefin, wherein the pyrolysis is conducted in a pyrolysis reaction tube in which a porous inorganic substance with a pore diameter of 1 μm~5 mm, a porosity of 10~80%, and a maximum specific surface area of 0.1 $m^2/g$ is inserted or filled.

2. The process for pyrolysis of hydrocarbons according to claim 1, wherein the porous inorganic substance is inserted or filled to 5 to 30 vol%.

3. The process for pyrolysis of hydrocarbons according to claim 1, wherein the porous inorganic substance is selected from the group consisting of alumina, silica, magnesium oxide, calcium oxide, ferrous oxide, zirconium oxide, and a mixture thereof.

4. The process for pyrolysis of hydrocarbons according to claim 1, wherein the porous inorganic substance is inserted or filled into a part of or a is whole pyrolysis reaction tube, in line.

5. The process for pyrolysis of hydrocarbons according to claim 1, wherein the porous inorganic substance is coated with an alkali compound selected from the group consisting of $KVO_3$, $K_2CO_3$, $KBO_2$, $KWO_3$, $KNbO_3$, $K_2SO_4$, and a mixture thereof.

6. The process for pyrolysis of hydrocarbons according to claim 1, wherein the insert or filling is a filling body, a dividing body that divides the inside of the reaction tube in a lengthwise direction, or a mixed body thereof.

7. The process for pyrolysis of hydrocarbons according to claim 6, wherein the tilling body has a tubular shape the inside of which is empty, a cylindrical shape, or a ring shape.

8. The process for pyrolysis of hydrocarbons according to claim 6, wherein the dividing body is an equal division body, which consists of a plurality of blades, which has the same distances from the one side edge where they are contacted with each other to the other side edge, so that a reaction mixture of hydrocarbons and steam can be equally divided.

9. The process for pyrolysis of hydrocarbons according to claim 6, wherein the dividing body is an unequal division body, which consists of a plurality of blades, of which distances from the one side edge where they are contacted with each other to the other side edge are the same or some of them are different, so that a reaction mixture of hydrocarbons and steam can be unequally divided.

* * * * *